US012151149B2

(12) United States Patent
Kaye

(10) Patent No.: US 12,151,149 B2
(45) Date of Patent: Nov. 26, 2024

(54) LACROSSE TRAINING DEVICE

(71) Applicant: Christopher J. Kaye, Eastlake, OH (US)

(72) Inventor: Christopher J. Kaye, Eastlake, OH (US)

( * ) Notice: Subject to any disclaimer, the term of this patent is extended or adjusted under 35 U.S.C. 154(b) by 0 days.

(21) Appl. No.: 16/361,289

(22) Filed: Mar. 22, 2019

(65) Prior Publication Data

US 2019/0217173 A1 Jul. 18, 2019

Related U.S. Application Data

(63) Continuation-in-part of application No. 15/927,541, filed on Mar. 21, 2018, now Pat. No. 10,238,905.

(51) Int. Cl.
*A63B 69/00* (2006.01)
*A63B 1/00* (2006.01)
*A63B 102/14* (2015.01)

(52) U.S. Cl.
CPC ..... *A63B 69/00* (2013.01); *A63B 1/00* (2013.01); *A63B 2102/14* (2015.10); *A63B 2209/00* (2013.01); *A63B 2225/093* (2013.01)

(58) Field of Classification Search
CPC ..... A63B 15/005; A63B 69/0002; A63B 2069/0008; A63B 60/04; A63B 2102/14; A63B 69/00; A63B 1/00; A63B 2225/093; A63B 71/0622; A63B 2071/0655; A63B 2071/0625; A63B 2209/00; A63B 59/00
USPC ..... 473/437, 457, 446, 519, 513
See application file for complete search history.

(56) References Cited

U.S. PATENT DOCUMENTS 3,578,801 A * 5/1971 Piazza ..... A63B 59/50 473/457
4,027,886 A * 6/1977 Katsube ..... A63B 69/3632 473/234
4,274,631 A * 6/1981 Hayazaki ..... A63B 69/0002 473/457
4,634,121 A * 1/1987 Sasaki ..... A63B 15/00 473/457
4,809,975 A * 3/1989 Lee ..... A63B 15/005 473/256
4,898,386 A * 2/1990 Anderson ..... A63B 49/00 473/457
4,969,921 A * 11/1990 Silvera ..... A63B 69/3632 473/234
5,330,190 A * 7/1994 Oakley, Jr. ..... A63B 15/005 473/234
5,360,209 A * 11/1994 Mollica ..... A63B 15/005 473/457

(Continued)

*Primary Examiner* — Jeffrey S Vanderveen
(74) *Attorney, Agent, or Firm* — Gugliotta & Gugliotta, LPA

(57) ABSTRACT

A sports training apparatus for practicing lacrosse comprising an elongate rigid member extending along a length between first and second ends, first and second stops secured to the elongate rigid member, and a slidable mass on the elongate rigid member, slidable along the elongate rigid member between the first aid second stops. A kit for retrofitting a lacrosse stick for practicing lacrosse composing first and second stops, securable to a lacrosse stick; and a slidable mass, having a passage along an axis there through. The instant abstract is neither in tended to define the invention disclosed in this specification nor intended to limit the scope of the invention in any way.

19 Claims, 10 Drawing Sheets

(56) References Cited

U.S. PATENT DOCUMENTS 5,474,511 A * 12/1995 Dantolan ..... A63B 21/05 482/93
5,590,875 A * 1/1997 Young ..... A63B 15/005 473/457
5,634,856 A * 6/1997 Rainey ..... A63B 60/04 473/234
5,711,718 A * 1/1998 Mueller ..... A63B 15/005 473/234
6,461,163 B1 * 10/2002 Gallagher ..... A63B 15/005 434/252
6,949,036 B2 * 9/2005 Ciesar ..... A63B 15/00 473/457
6,955,610 B1 * 10/2005 Czaja ..... A63B 15/005 473/256
7,056,240 B2 * 6/2006 Brock ..... A63B 69/0002 473/457
7,147,580 B2 * 12/2006 Nutter ..... A63B 15/005 473/457
7,297,078 B2 * 11/2007 Libonati ..... A63B 15/005 473/457
8,118,693 B2 * 2/2012 Tande ..... A63B 15/005 473/457
8,540,584 B1 * 9/2013 Sorenson ..... A63B 69/36 473/256
8,888,614 B2 * 11/2014 Nutter ..... A63B 69/0002 473/457
9,095,739 B2 * 8/2015 Sillik ..... A63B 69/0002
9,433,812 B2 * 9/2016 Sillik ..... A63B 69/0002
9,833,676 B2 * 12/2017 Smith, Jr. ..... A63B 69/0002
9,943,740 B2 * 4/2018 Mayers, III ..... A63B 69/0002
10,238,905 B2 * 3/2019 Kaye ..... A63B 15/005
2004/0048696 A1 * 3/2004 Ciesar ..... A63B 69/0002 473/457
2004/0176194 A1 * 9/2004 Mitchell ..... A63B 21/0608 473/437
2007/0049431 A1 * 3/2007 Meyer ..... F41B 15/02 473/513
2007/0155525 A1 * 7/2007 Davenport ..... A63B 15/005 473/256
2010/0285907 A1 * 11/2010 Deschesnes ..... A63B 21/055 473/437

* cited by examiner

LACROSSE TRAINING DEVICE

RELATED APPLICATIONS

The present invention is a Continuation in Part of U.S. Ser. No. 15/927,541, which claims benefit of U.S. Provisional Application No. 62/247,862 filed on Mar. 22, 2017, both of which are incorporated by reference as if fully rewritten herein.

BACKGROUND OF THE INVENTION

1. Field of the Invention

The present invention relates generally to a sports training apparatus and, more particularly, to a training device that aids in developing the proper throwing motions and improved exit velocity for the sport of lacrosse.

2. Description of the Related Art

Lacrosse is a sport that utilizes a stick that features a head and net on the end of a shaft which is used for passing, catching and shooting a hard rubber ball. Accurate control and shot touch and velocity are critical skills to master for success.

Passing and especially shooting, often requires the release point and the stick trajectory be generated from a variety of positions and angles. Since there is a goalie and defensive players trying to cutoff shooting angles and initiating other defensive means to prevent the hall from entering the goal, the shot velocity also greatly influences shooting success.

It is thus an object of the present invention to provide a lacrosse training device.

It is another object of the present invention to provide such a device to allow a user to practice shooting, and especially full-speed snap-off shots.

It is a further object of the present invention to allow for the full-speed practice of a lacrosse shot in a useful manner but without the discharging of a lacrosse bag or other projectile.

Further objects and advantages of the invention will become apparent in the course of the following description of the invention.

SUMMARY OF THE INVENTION

This embodiment of the present invention discloses a sports training apparatus comprising an elongate rigid member to which an axial extension is secured. The elongate rigid member possessing first and second stops as well as a slidable mass on the elongate rigid member between the first and second stops.

Another embodiment consists of a perpendicular to the elongate rigid member is an extension possessing first and second stops secured to the elongate rigid member, as well as a slidable mass on the elongate rigid member between the first and second stops.

The elongate rigid extension member may be substantially straight The first and second stops may be removable. The first and second stops may be adjustably located on the elongate rigid member. The second stop may be removably attached proximate to the second (far) end, wherein the first stop may be secured between the first and second ends.

The elongate rigid extension member may consist of adjustment features to allow variable extension and the elongate rigid extension member may also be removable from the elongate member.

The elongate rigid extension member may include a curved portion to better simulate the actual ball release from the lacrosse head when using a game stick.

This more genuine ball release may also be accomplished by allowing the sliding mass to move at an angle from to the axis of the stick by a slightly different geometry extension member along which the slicing mass can move. This extension member can have an angle or curvature from 1 degree to 179 degrees, relative to the axis of the shaft, one preferred embodiment being 60 degrees.

Another similar approach would be to incorporate this strategy to the perpendicular extension, to this case, the sliding mass motion that simulates ball release can be accomplished by adjusting the angle of the axial elongate member, the additional perpendicular extension on which the sliding mass moves, or a combination of both.

Yet another design that is employed to account for the fact that the actual ball can fall out of the pocket during actual play is to utilize an extension that can pivot (total travel of 1" to 4") with respect to its attachment point.

The slidable mass may also be attached to an elastic deformable band, so that although it can move along its axis to simulate the ball's freedom of motion in actual play conditions, enough force must be generated to strike the distal stop with adequate force to produce the desired audible and tactile feedback.

In all embodiments, the slidable mass may have a weight and a center of gravity selected to replicate a lacrosse ball and a typical lacrosse head. The slidable mass may be replaceable. The slidable mass may have a weight selected to be greater than the combination of a lacrosse ball and any lacrosse head. The sliding mass be asymmetrical and/or use an offset center of axis.

The training device may include a gyroscope mounted to the elongate member in a rigid fashion that will help develop the muscle memory for cradling, ball control and shooting skills.

The slidable mass may also include standing pins or other features that allow it to strike the distal stop, but only after it has overcome the compression force of a spring that is located between the sliding mass and the distal stop. Although the slidable mass can move along its axis to simulate the ball's freedom of motion in actual play conditions, enough force must be generated to overcome the spring so that it can strike toe distal stop with adequate force to produce toe desired audible and tactile feedback According to a further embodiment of toe present invention there is disclosed a kit for retrofitting a lacrosse stick for practicing lacrosse comprising first and second stops, securable to a lacrosse stick; and a slidable mass, having a passage along an axis there through.

The retrofit kit can be such that the sliding mass moves along toe axis of the stick either by using the stick itself as the guide or by attaching an axial and/or perpendicular extension member along which the sliding mass can move.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

The advantages and features of the present invention will become better understood with reference to the following more detailed description and claims taken in conjunction with the accompanying drawings, in which like elements are identified with like symbols.

This further embodiment

These listed variations are provided for purposes of disclosing known variations of the best mode for carrying out the invention is presented; however, the order of presentation is not intended to imply a preference in terms of the inventions preferred embodiment but are provided for purposed of broadly disclosing the present innovation. It should be understood that the legal scope of the description is defined by the words of the claims set forth at the end of this patent and that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims.

DESCRIPTION OF THE PREFERRED EMBODIMENTS

The best mode for carrying out the invention is presented in terms of its preferred embodiment, herein depicted within the Figures.

1. Detailed Description of the Figures

Before explaining the present invention in detail, it is important to understand that the invention is not limited in its application to the details of the construction illustrated and the steps described herein. The invention is capable of other embodiments and of being practiced or carried out in a variety of ways. It is to be understood that the phraseology and terminology employed herein is for the purpose of description and not of limitation.

Figure 1:
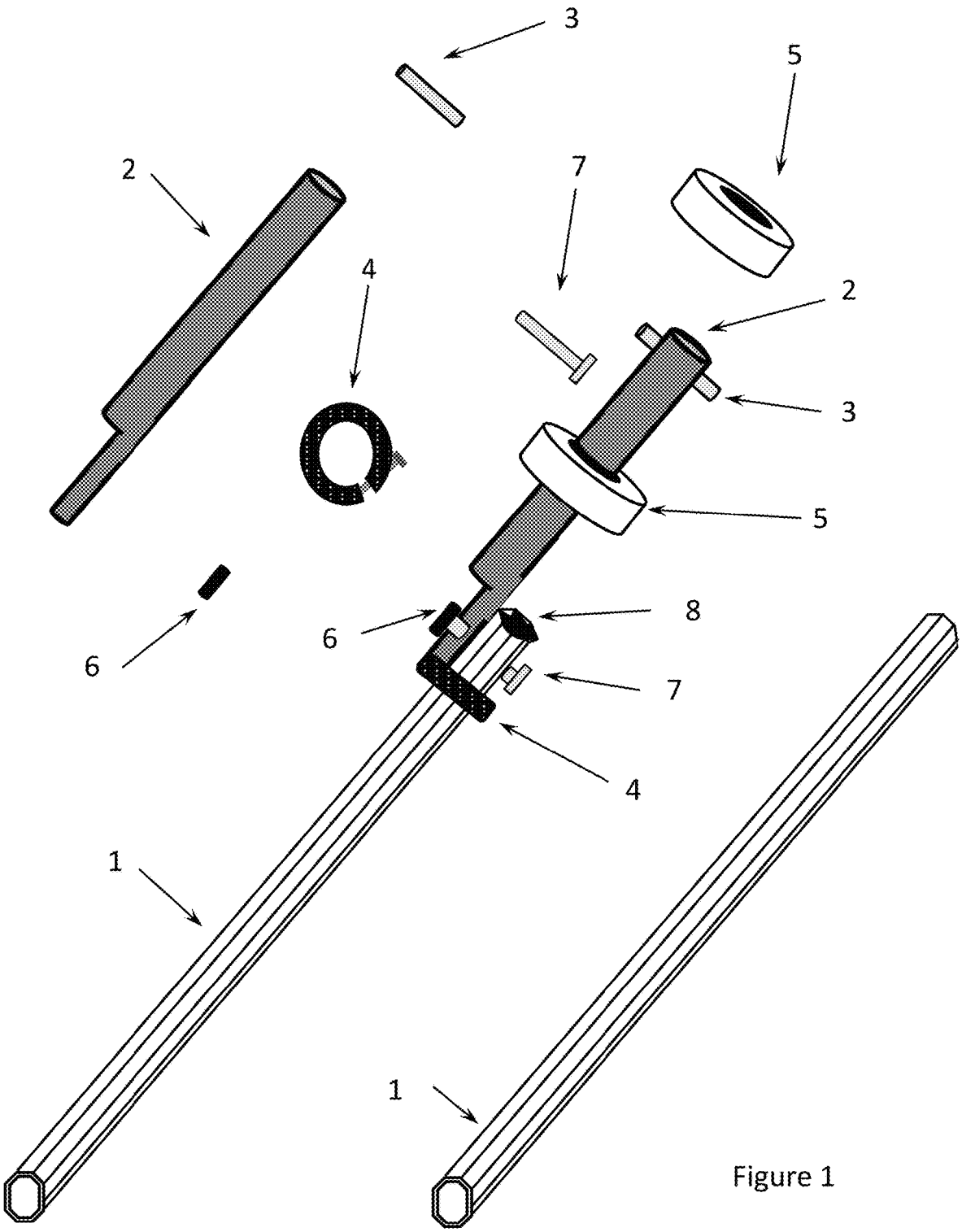
FIG. 1 shows the component parts that support a let approach as a further embodiment of the embodiment of an elongate extension that follows the axis of the shaft.

Referring to FIG. 1, a sports training apparatus for practicing lacrosse according to a first embodiment of the invention is shown generally The apparatus comprises an elongate shaft 1 with an axial extension 2 with a slidable mass 5 thereon, restricted between the distal stop 3 and the top of the shaft that acts as the proximal stop, 8. The axial extension is anchored along the lengthwise axis of the elongate shaft 1 by 4, 6, and 7. The elongate shaft 1 may have an octagonal cross-section, as illustrated in FIG. 1, similar to a standard lacrosse stick, although other cross-sections, such as, by way of non-limiting example, round or oval, may be useful, as well. The elongate shaft 1 may be hollow or solid and can be composed of wood, metal, polymers and composites or other such materials. Although the elongate shaft 1 is illustrated as a fixed length shaft, it will be appreciated that the elongate shaft 1 could have an adjustable length option. The individual components are also shown in order to demonstrate another embodiment where the players personal shaft could be modified to accept either the training device darned or with the game acceptable lacrosse head.

Figure 2:
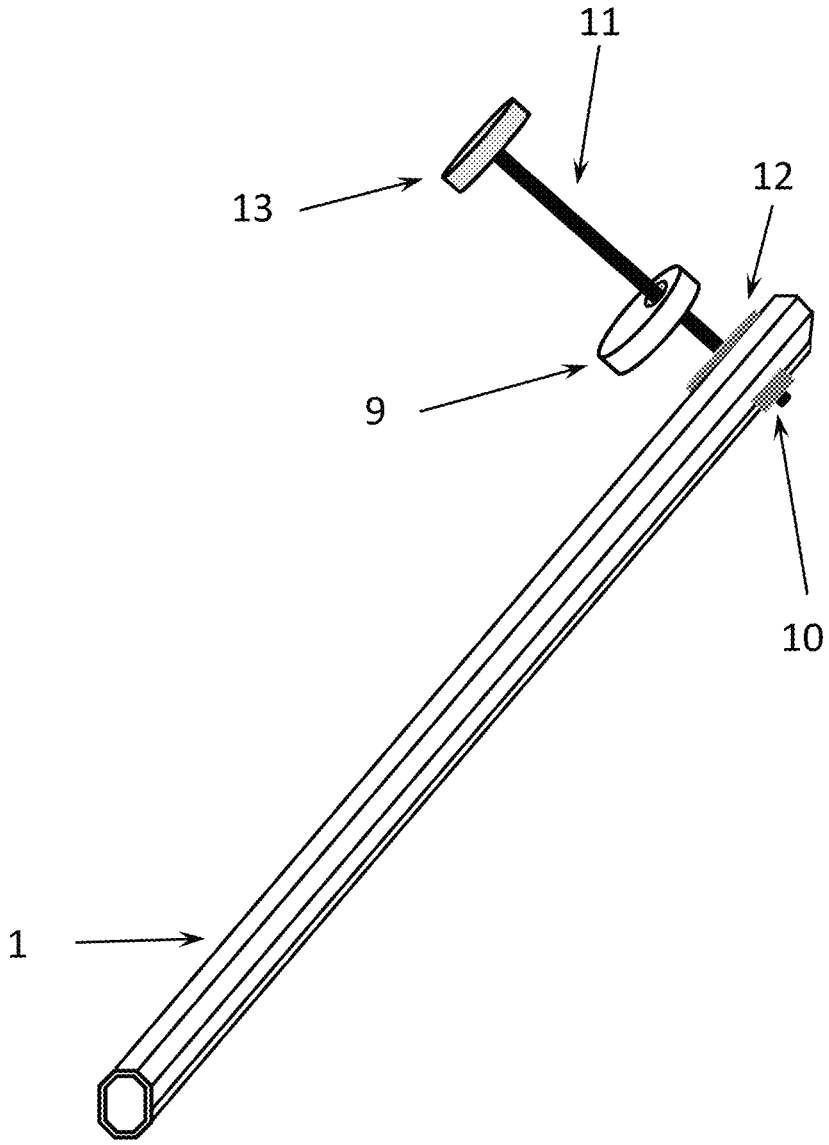
FIG. 2 is a perspective view of sports training apparatus for practicing lacrosse according to a first embodiment of the present invention showing the perpendicular extension with the sliding mass. The perpendicular geometry may better simulate the ball falling out of the pocket prematurely, also being advantageous for the kit approach where components are provided to be attached to the players personal lacrosse stick shaft (after removal of the lacrosse head).

FIG. 2 shows the standard elongate shaft 1, but now outfitted with a perpendicular guide rod 11 anchored by parts 10 and 12 with sliding mass 9 and distal stop 13. The proximal stop or start position is created by the elongate shaft itself.

The slidable mass 9 includes a hole there through with a size and profile shape selected to allow the slidable mass 9 to slide freely along the axis 11 and it should be noted that this opening can be offset rather than located at the center. The slidable mass 9 may be formed in one piece, as illustrated, or it may be formed in a plurality of pieces secured together around the elongate shaft 1, an axial extension 2 or the perpendicular guide rod 11 or other apparatus for securing the sliding mass.

The slidable mass as shown as 5 or 9 or other illustrations may be formed using such as, by way of non-limiting example, polymer, rubber, wood or any other material to simulate the weight of a lacrosse ball, or may be selected to be a greater mass, so as to build a user's strength.

Figure 3:
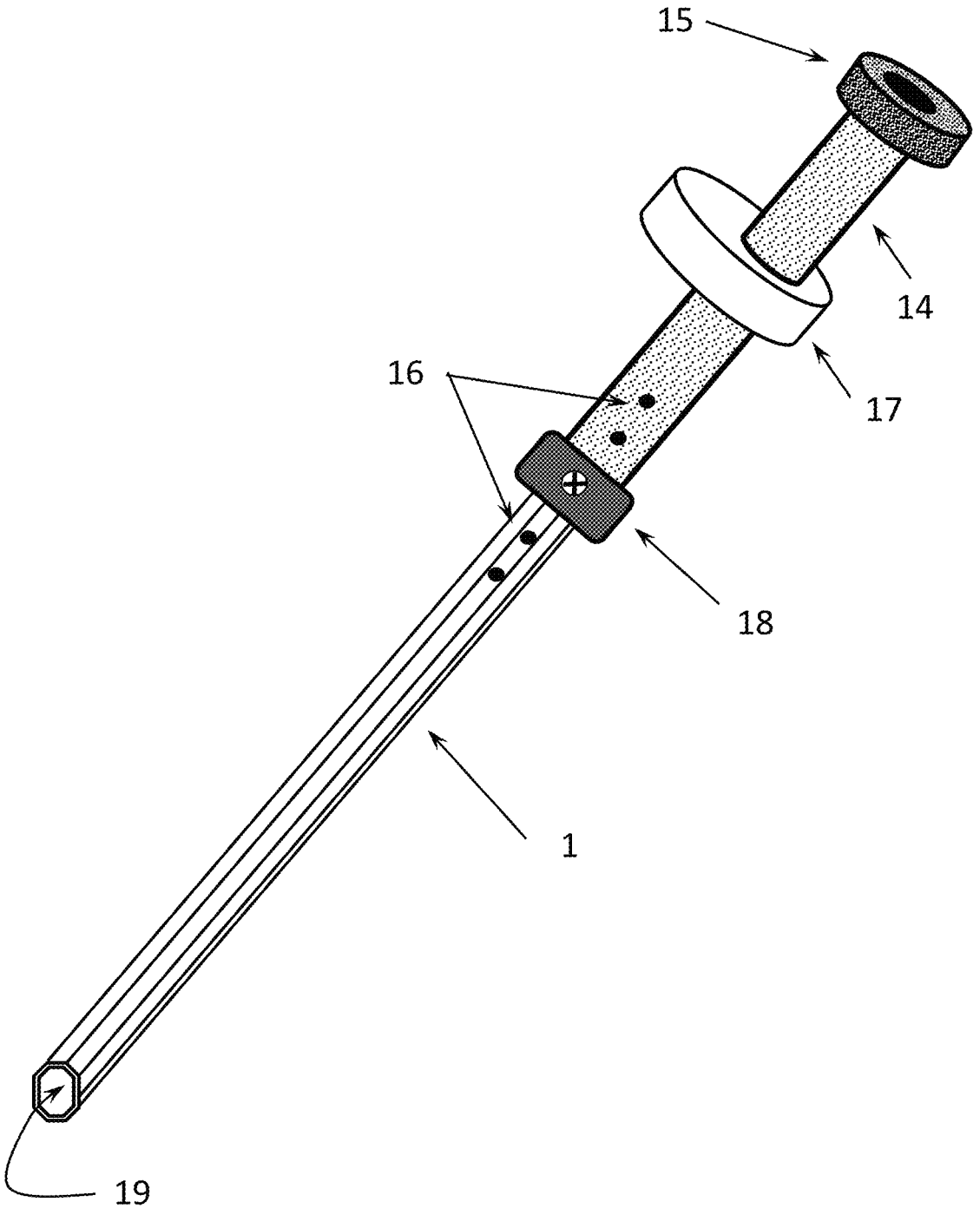
FIG. 3 shows the curved shaft approach to the elongate extension that attaches axially.

FIG. 3 shows an axial extension 14, but in contrast to that shown in FIG. 1 which is off-center, this extension is fully in-line with shaft 1. In this illustration it is larger than the shaft aid fits over it, but it could be sized smaller to fit inside for anchoring. In addition, similar results can be obtained by merely using a longer shaft 1. In add-on, the sliding mass 17 is shown with a through-hole and is located on the outside of axial extension 14. Alternately, the slidable mass 17 may be adapted to be located within the central passage 19 of the elongate shaft 1 or inside axial extension 14, with appropriately located first and second stops, to control the slidable motion therein. As illustrated in FIG. 3, there may be multiple stop bores, 16, such that the first and second stop locations are adjustable, dependent on a user's needs. Adjusting the locations of the first aid second stops, 15 and 18, allows for adjustment of the length of the slide portion of 14. The first and second stops may be attached by cotter pins, as are commonly known, to allow for selective removal, or they may be secured to the elongate shaft 1 and/or to guide rod 14 by any means as is commonly known in the art.

Figure 4:
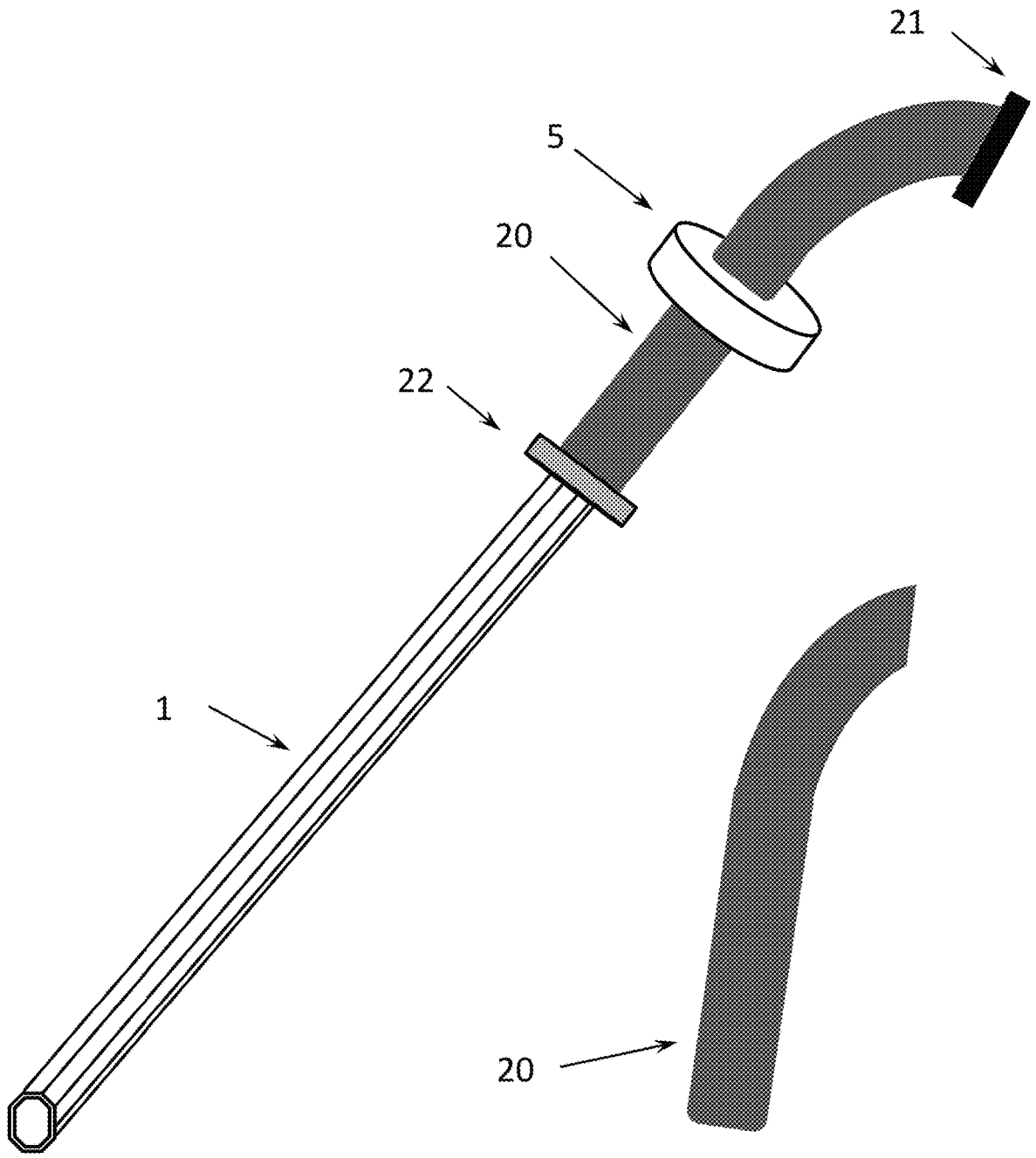
FIG. 4 is elongate extension that attaches axially to a lacrosse shaft or similar shaft and has the ability to have its length adjusted according to a further embodiment of the present invention.

FIG. 4 shows a curved extension guide rod 20 attached to the end of the elongate shaft 1. The guide rod 20 can be attached to the end of the elongate shaft 1 as illustrated but can also be attached to the side as in FIG. 1 or perpendicular as in FIG. 2. As with other embodiments described, the sliding mass 5 is positioned between the first and second stops, 21 and 22. The first and second stops, 21 and 22, may be formed as rods or pins, which pass through the first and second stop bores, or by cylindrical or other shapes as illustrated, such that they extend beyond the outside surface and therefore prevent the slidable mass such as 5 from sliding there beyond. The curved slide portion 20 may be utilized to better replicate the motion required when a lacrosse ball is within a deep pocket prior to shot release, as is more common with men's, boy's or goalie's lacrosse sticks.

Figure 5:
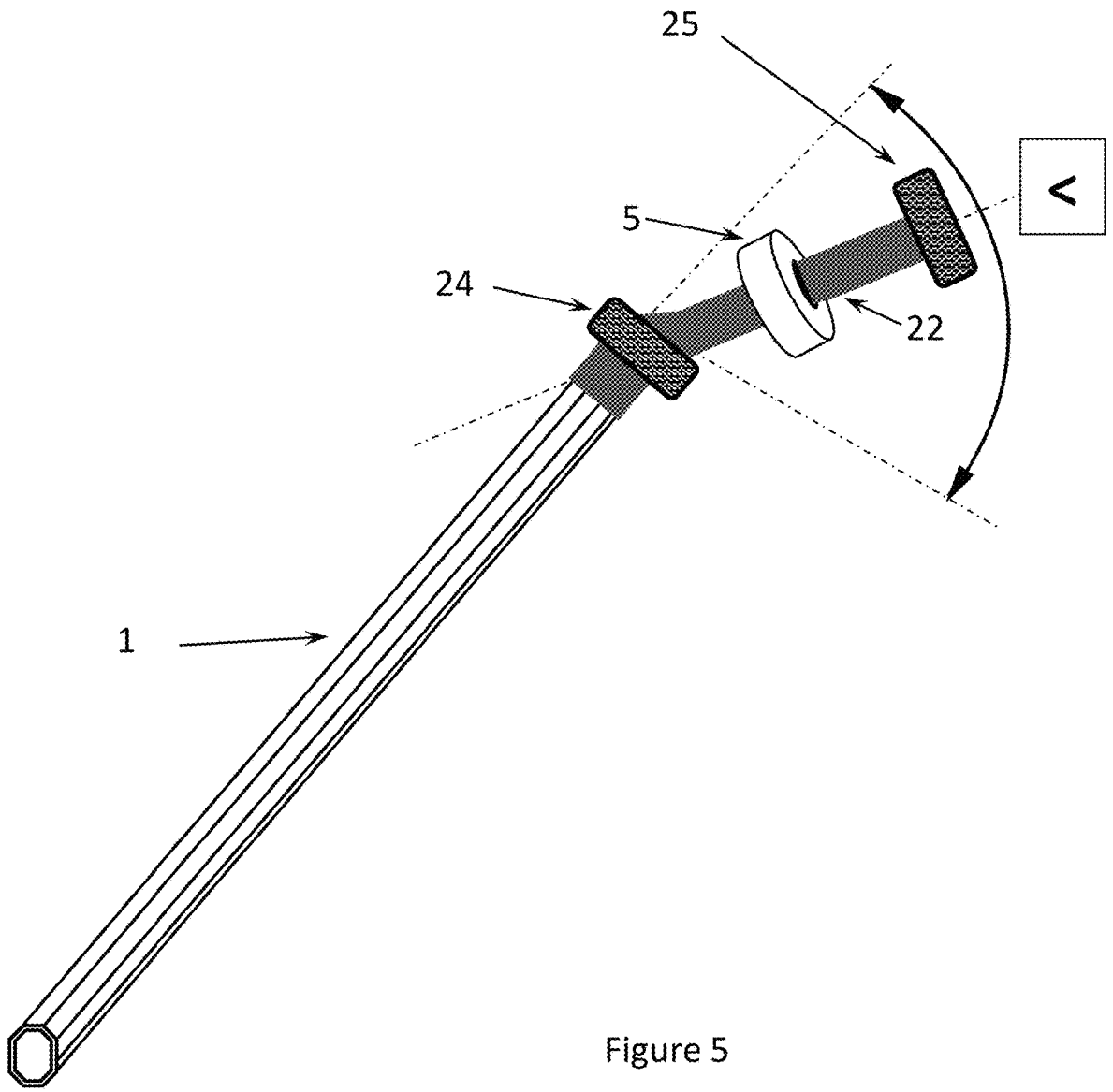
FIG. 5 is elongate extension that attaches axially to a lacrosse shaft or similar shaft, but also possesses angular deflections between 5 degrees and 85 degrees from the elongate shaft axis.

Turning now to FIG. 5 where a standard lacrosse stick shaft 1 is now outfitted with an angled elongate shaft 23 to accomplish the proper throwing motion and simulated release point required for game-like action. Sliding mass 5 will travel between stops 25 and 26 during use.

Figure 6:
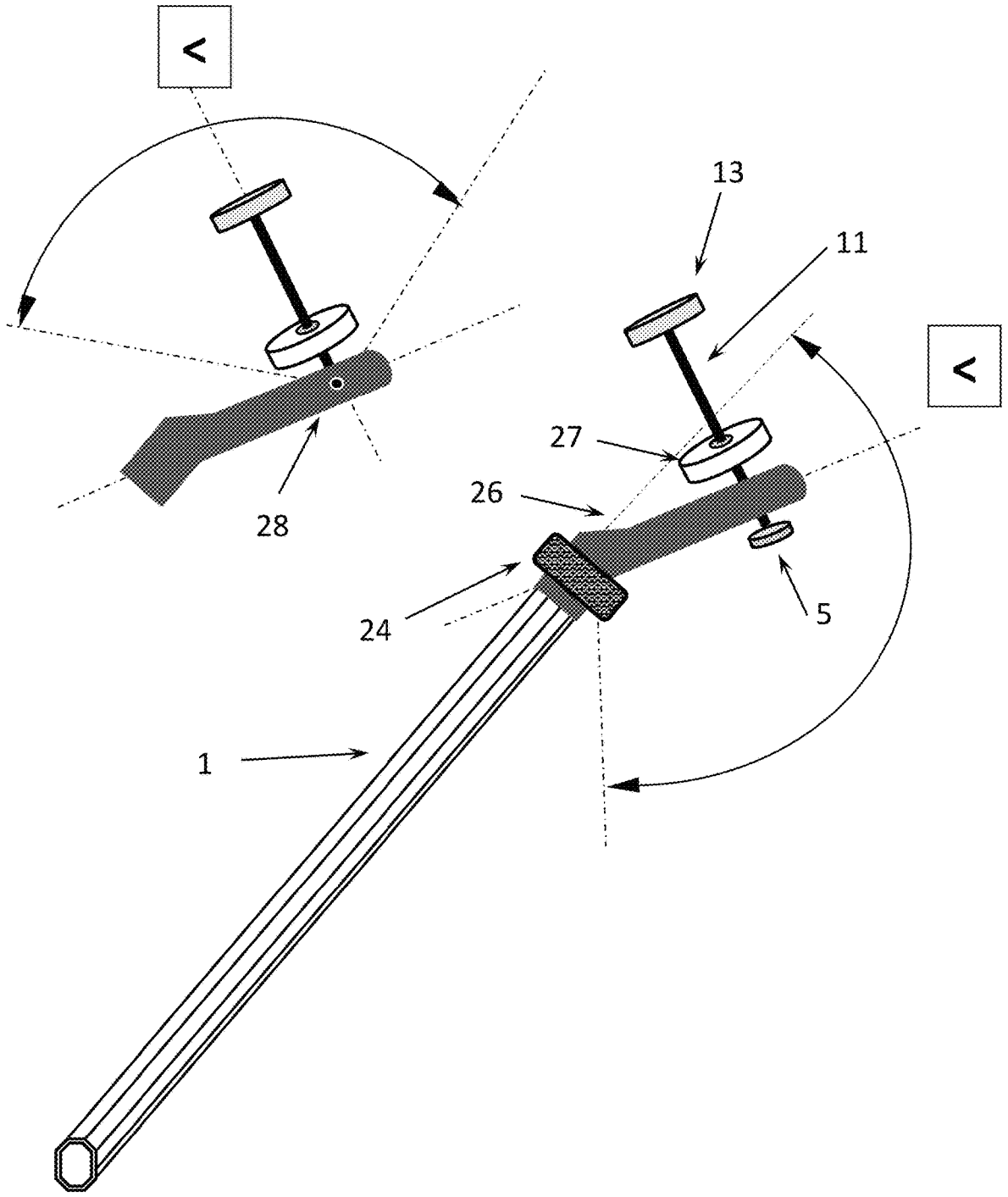
FIG. 6 shows the approach where an angled axial extension is used with a guidance rod for the sliding mass. In this case, the angle of the axial extension, the angle of the guidance rod, or a combination of both can be utilized to create the desired ball release motion.

As illustrated in FIG. 6, the elongate shaft 26 can have a variety of angles, again to allow for adjustment to the optimal simulated release point for ball exiting the lacrosse head. In addition to or instead of, the angle of the guide rod 11 can also be adjusted using extension 28 for the same purpose. It will be appreciated that other alignment methods or attachment techniques could be employed, as are commonly known.

Figure 7:
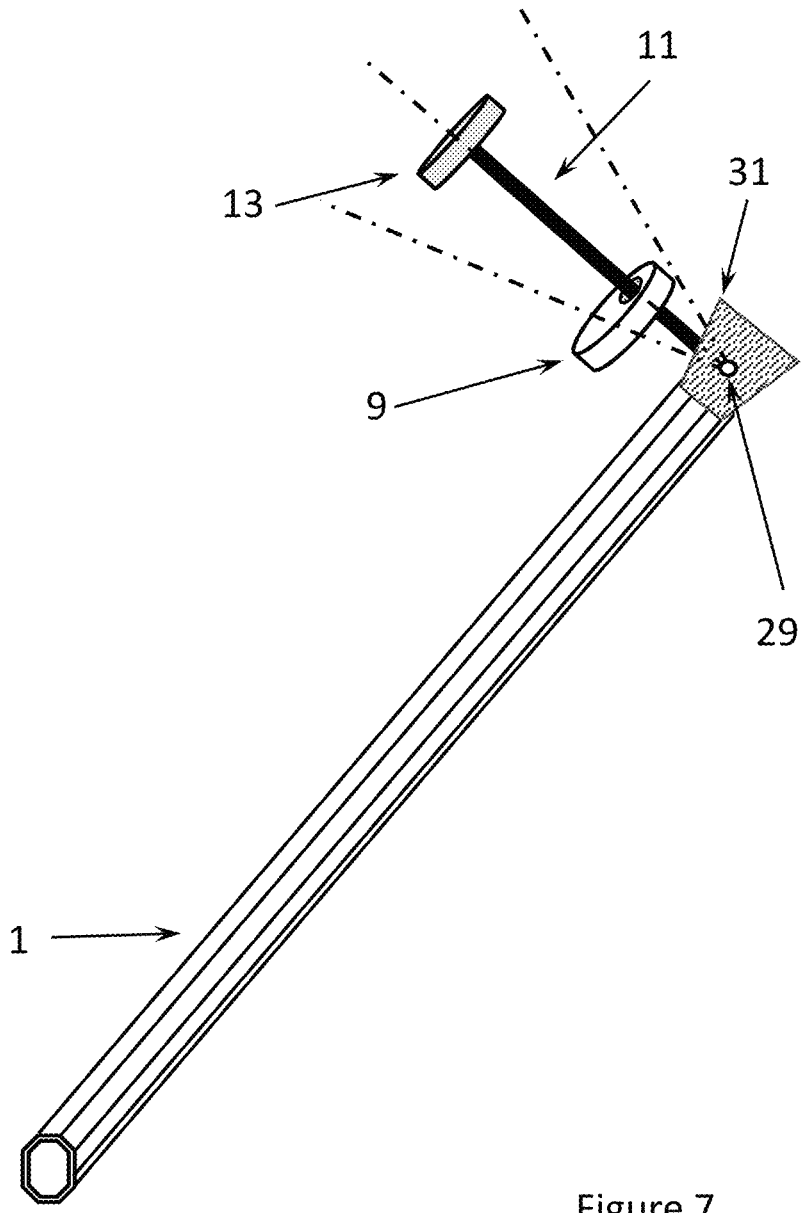
FIG. 7 shows the guidance rod pinned so that it can pivot from 1" to 4" in a dynamic in manner.

FIG. 7 illustrates a further embodiment of the device where the angle of the perpendicular rod can pivot about pivot point 29 in a dynamic manner constrained by attachment top 31.

Figure 8:
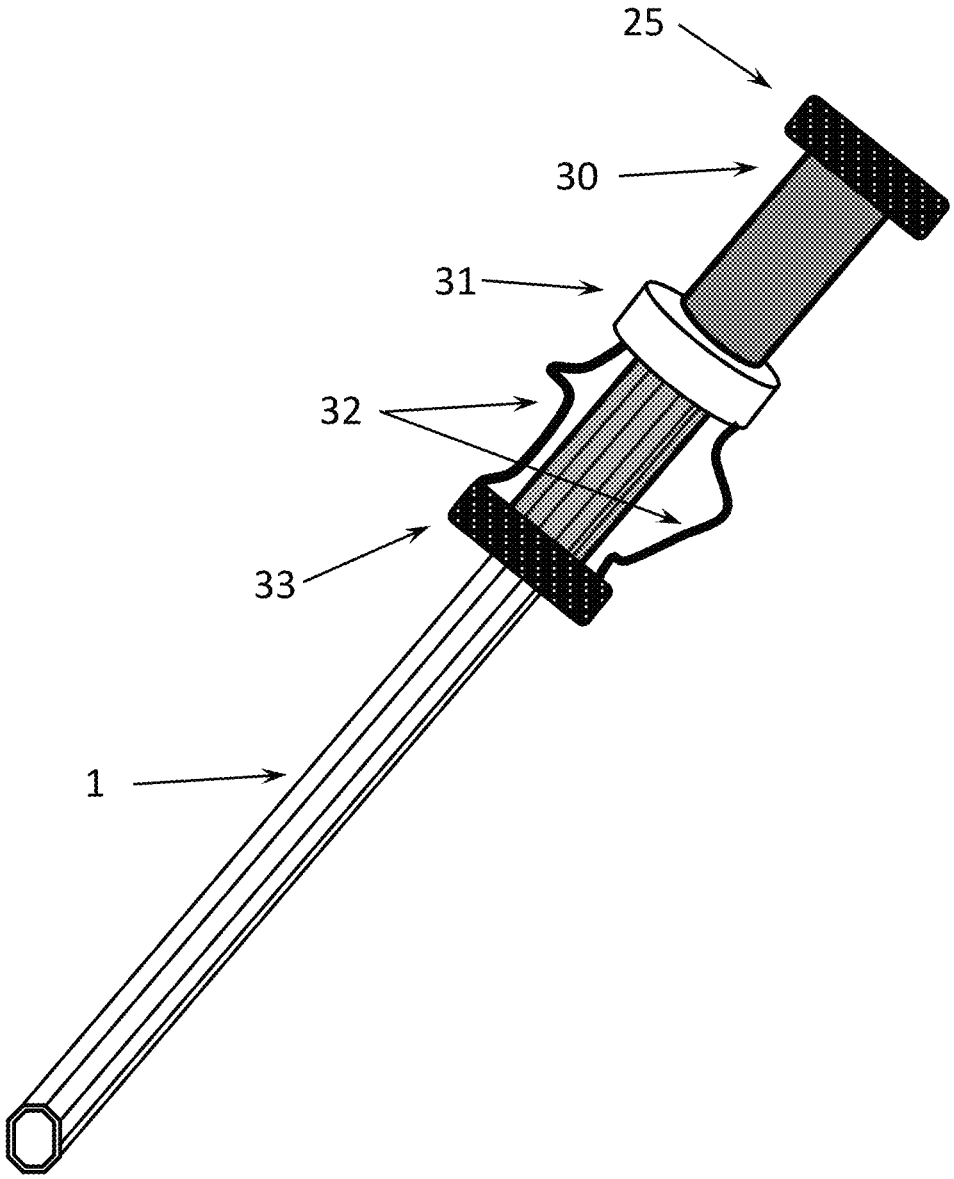
FIG. 8 shows the slider constrained by resistance band(s). The component elastic modulus would need to be overcome in order to achieve the optimal audible, tactile and/or visual feedback in this further embodiment of the present invention.

Turning now to FIG. 8, rather than having the slicing mass move entirety freely, elastic bands 342 are attached to mass 31 and stop 33. The resistance of these bands must be overcome in order to gain the desired tactile, audible aid visual response that the optimal shot has been performed.

Figure 9:
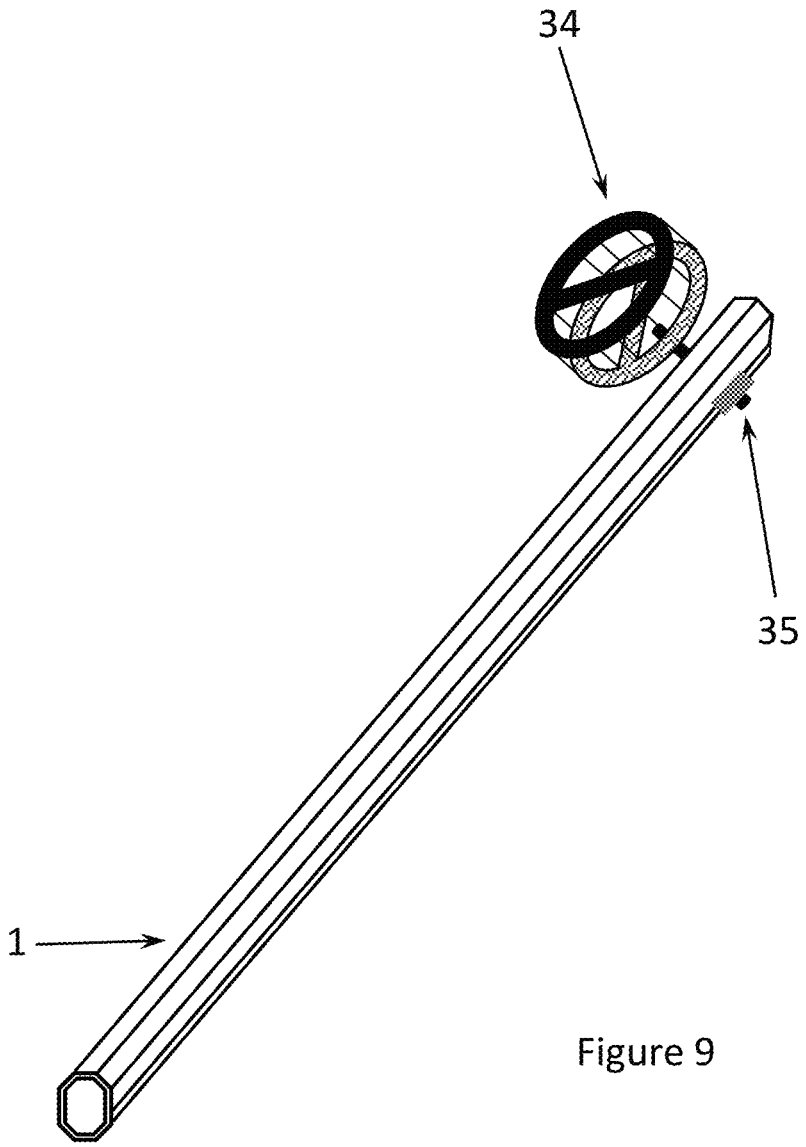
FIG. 9 shows the rigid attachment of a gyroscope to the shaft in a further embodiment apparatus of the sports trailing device.

A static mass (as shown in FIG. 9) includes a gyroscope 34 or other device to produce a torque therein, to aid in the development of control, strength, coordination and muscle memory of a user. The addition of said gyroscope may generate forced precession, as is commonly known. The addition of these forces aids in the development of user control, strength and muscle memory.

Figure 10:
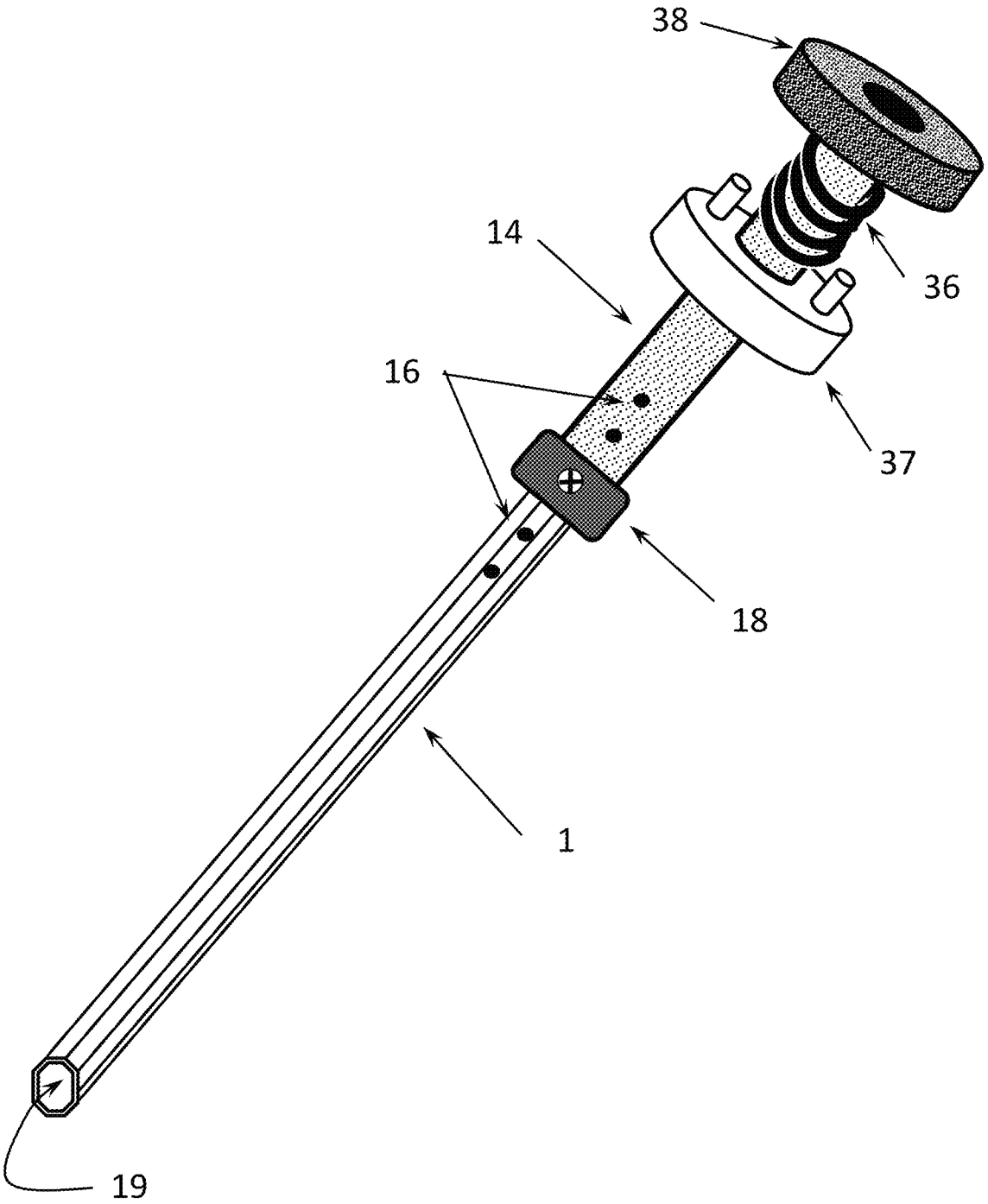
FIG. 10 shows the adjustable elongate axial extension attached to a lacrosse shaft or similar rigid, elongate shaft, and inducing a sliding mass with standing strike pins and a compression spring.

FIG. 10 shows a device with an elongate axial extension 14 (adjustable version shown). It also includes a compression spring 36 between the sliding mass 37 and the distal stop 38. This necessitates the user generate enough shot velocity to overcome the spring compression force so that the sliding mass strike pins or other standing features contact the distal stop. By utilizing springs of various compression strengths, the device can be adjusted to the user's skill level and ability.

2. Operation of the Preferred Embodiment

A challenge with team sports is that it can be difficult to hone skills independently, but a significant training advantage of this invention is the ability to practice without partners). The player can practice independently, even in a confined area and develop different shot angles and throwing motions that result in better performance. The proprioception and kinesthetic effects (fast twitch muscles and muscle memory) that are developed by repetition of key motions and full-speed practice cannot be underestimated.

A key feature of the invention is the ability of the player to establish the kinesthetic sense for stick motion for ball control and shooting. This muscle memory will be reinforced as the player understands the proper movement(s) that generate velocity without sacrificing control.

Another advantage of the invention is for pre-game warm-ups. Although stretching, pass/catch lines, and other drills can be performed, it is usually not practical for players to attempt hard, full-speed shots prior to the game. The players, therefore, cannot snap off shots and get loose and fully prepared from a shooting perspective for the game using their standard equipment. Choices are then limited to the passing aid catching drills or swinging full-speed with an empty stick. The training stick is far superior in this regard since it allows the player to simulate shots at full speed with a stick that better simulates actual shots when there is a ball in the pocket. This translates into an advantage since the player can be ready to compete at full speed from the start of the game.

The Title, Background, Summary, Brief Description of the Drawings and Abstract of the disclosure are hereby incorporated into the disclosure and are provided as illustrative examples of the disclosure, not as restrictive descriptions. It is submitted with the understanding that they will not be used to limit the scope or meaning of the claims. In addition, in the Detailed Description, it can be seen that the description provides illustrative examples and the various features are grouped together in various embodiments for the purpose of streamlining the disclosure. This method of disclosure is not to be interpreted as reflecting an intention that the darned subject matter requires more features than are expressly recited in each claim. Rather, as the following claims reflect, inventive subject matter lies in less than all features of a single disclosed configuration or operation. The following claims are hereby incorporated into the Detailed Description, with each claim standing on its own as a separately claimed subject matter.

The claims are not intended to be limited to the aspects described herein, but is to be accorded the full scope consistent with the language claims and to encompass all legal equivalents. Notwithstanding, none of the claims are intended to embrace subject matter that fails to satisfy the requirement of 35 U.S.C. § 101,102, or 103, nor should they be interpreted in such a way. Any unintended embracement of such subject matter is hereby disclaimed.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated It is intended that the scope of the invention be defined by the Claims appended hereto and their equivalents. Therefore, the scope of the invention is to be limited only by toe following claims.

What is claimed is:

1. A lacrosse training device comprising:

an elongated shaft having an interior bore and retaining a free flowing sliding mass moving axially collinear with the bore along a length of said shaft, the sliding mass having travel constrained by a first stop and a second stop positioned external to the elongated shaft, wherein the sliding mass is not impeded by any structure within the bore between the first and second stops.

2. The lacrosse training device of claim 1, said stops further comprising one or more adjustable stop locations along an exterior length of the elongated shaft for limiting the movement of said sliding mass along the exterior length.

3. The lacrosse training device of claim 2, further comprising:

an extension shaft affixed to and extending from said elongated shaft along a portion of the length;

wherein said sliding mass is constrained by said stops about said extension shaft.

4. The lacrosse training device of claim 1, further comprising:

an extension shaft affixed to and extending from said elongated shaft along a portion of the length;

wherein said sliding mass is constrained by stop-said stops about said extension shaft.

5. A method of developing lacrosse skills comprising:

obtaining a lacrosse training device of claim 1;

moving the slidable mass along an axis of the elongated shaft to simulate a ball's freedom of motion in actual play conditions with enough force to overcome a shock absorbing feature so that it can strike the distal stop with adequate force to produce the desired audible and tactile feedback.

6. The lacrosse training device of claim 1, wherein adjustability of the stop locations allows flexibility of the sliding mass distance to correspond with the physical height of a user, a skill level of a user or a specific player position.

7. The sports training apparatus of claim 1, further comprising a kit wherein the slidable mass and stops are selectively removable from said elongate shaft.

8. The sports training apparatus of claim 7, wherein at least said first stop is adjustably secured at different locations laterally along said elongated rigid member.

9. A sports training apparatus of claim 7, wherein said slidable mass further has a weight equal to or greater than that of a lacrosse ball.

10. The lacrosse training device of claim 1, further comprising one or more adjustable stop locations along an exterior length of the stick for adjusting the overall length and for limiting the movement of said sliding mass within a bore of said stick.

11. A sports training apparatus for practicing lacrosse comprising:

an elongate shaft formed of a rigid member extending along a length between a gripping portion at a proximal end and incorporating a slide portion at a distal end;

a first stop secured to the slide portion at or near the distal end;

a second stop secured to the slide portion proximal to said first stop;

a free flowing slidable mass retained on said slide portion on said elongated shaft between said first stop and said second stop and external to the elongated shaft, wherein the slidable mass is not impeded by any structure within the slide portion between the first and second stops; and said slidable mass has a weight and a center of gravity selected to replicate a release motion of a lacrosse ball.

12. The sports training apparatus of claim 11, further comprising:

an axial extension incorporating the slide portion at the distal end;

said first stop secured to said axial extension at or near the distal end;

said second stop secured to said elongate shaft, the axial extension or produced by the top of the elongate shaft; and said slidable mass on said axial extension between said first stop and said second stop.

13. The sports training apparatus of claim 12 wherein said axial extension can incorporate angles between 5 degrees and 85 degrees.

14. A sports training apparatus of claim 12, comprising:

said elongate shaft further forms the axial extension at an angle extending to the distal end to which is anchored a guide rod; and said sliding mass attached on or through the said guide rod perpendicular to an elongated axis of said rigid elongate shaft;

whereby the elongated shaft acts as the second stop at the proximal end and the first stop is attached to the distal end of said guide rod.

15. The sports training apparatus of claim 14, wherein said guide rod controls the sliding mass in order to pivot between from about 1" to about 4" in a dynamic manner.

16. The sports training apparatus of claim 12, wherein said axial extension is angled and affixed at a distal terminus of the elongated shaft.

17. The sports training apparatus of claim 12, wherein said axial extension is angled and affixed near a distal terminus of the elongated shaft.

18. The sports training apparatus of claim 12, further comprising a kit wherein the slidable mass, the stops and the axial extension are selectively removable from said elongate shaft.

19. A sports training apparatus for practicing lacrosse comprising:

an elongate shaft formed of a rigid member extending along a length and having a gripping portion at a proximal end;

an angled axial extension affixed at a distal terminus of the elongate shaft, the axial extension having an interior channel;

a first stop secured to said axial extension at a first end;

a second stop secured to said axial extension at a second end;

a freely moving slidable mass positioned in said interior channel of the axial extension between said first stop and said second stop that are located external to the interior channel, wherein said slidable mass has a weight and a center of gravity selected to replicate a lacrosse ball release motion, and wherein the slidable mass is not impeded by any structure within the interior channel between the first and second stops.

* * * * *